US010577780B2

(12) United States Patent
Zeng

(10) Patent No.: US 10,577,780 B2
(45) Date of Patent: Mar. 3, 2020

(54) MULTIFUNCTIONAL PULLOUT KITCHEN FAUCET

(71) Applicant: Xiamen KRC Building Materials Co., Ltd., Xiamen (CN)

(72) Inventor: Binhui Zeng, Xiamen (CN)

( * ) Notice: Subject to any disclaimer, the term of this patent is extended or adjusted under 35 U.S.C. 154(b) by 103 days.

(21) Appl. No.: 15/935,993

(22) Filed: Mar. 26, 2018

(65) Prior Publication Data

US 2019/0186111 A1 Jun. 20, 2019

(30) Foreign Application Priority Data

Dec. 19, 2017 (CN) ..... 2017 2 1786344 U

(51) Int. Cl.
*E03C 1/04* (2006.01)

(52) U.S. Cl.
CPC ..... *E03C 1/04* (2013.01); *E03C 2001/0415* (2013.01); *E03C 2001/0417* (2013.01); *Y10T 137/87579* (2015.04); *Y10T 137/9464* (2015.04)

(58) Field of Classification Search
CPC . F16L 31/02; F16L 11/0856; Y10T 137/9464; Y10T 137/87579; Y10T 137/87249; E03C 1/0404; E03C 1/0403; E03C 2201/40; E03C 2001/0417; E03C 1/04; F16K 31/02; F16K 11/0856
USPC ..... 137/801
See application file for complete search history.

(56) References Cited

U.S. PATENT DOCUMENTS 4,552,171 A * 11/1985 Farrell ..... E03C 1/0403 137/359
4,771,485 A * 9/1988 Traylor ..... E03C 1/0401 137/216
8,322,377 B2 * 12/2012 Di Nunzio ..... F16K 11/078 137/636.3
8,826,932 B2 * 9/2014 Seal ..... E03C 1/04 137/119.04
2007/0235091 A1 * 10/2007 Granot ..... E03C 1/0404 137/597
2009/0211654 A1 * 8/2009 Nobili ..... E03C 1/04 137/597
2014/0026980 A1 * 1/2014 Esche ..... E03C 1/0404 137/315.01
2014/0069520 A1 * 3/2014 Esche ..... E03C 1/0404 137/315.01

(Continued)

*Primary Examiner* — Jessica Cahill
(74) *Attorney, Agent, or Firm* — The Law Office Of Austin Bonderer, PC; Austin Bonderer

(57) ABSTRACT

Provided is a multifunctional pullout faucet. The pullout faucet comprises a pullout head, a faucet body, and a pullout hose assembly. The pullout head is provided with a purified-water outlet path and a mixed-water outlet path inside for outputting the purified water and for outputting the mixed water, respectively. The faucet body includes a housing, a valve, a mixed-water outlet tube, a purified-water inlet tube, a purified-water outlet tube, a cold-water inlet tube, a hot-water inlet tube, a purified-water switch and a mixed-water switch; wherein the valve is arranged within the housing, and the housing is connected to the pullout head. The pullout hose assembly is arranged within the housing for introducing the water flow. A purified-water switch is provided for the output of the purified water, and a mixed-water switch is provided for the output of the mixed water.

13 Claims, 6 Drawing Sheets

(56) References Cited

U.S. PATENT DOCUMENTS

| | | | | |
|---|---|---|---|---|
| 2015/0076252 | A1* | 3/2015 | Peteri | E03C 1/0404<br>239/428.5 |
| 2015/0368888 | A1* | 12/2015 | Song | E03C 1/057<br>137/78.1 |
| 2017/0101325 | A1* | 4/2017 | Ye | B01D 35/046 |

* cited by examiner

MULTIFUNCTIONAL PULLOUT KITCHEN FAUCET

TECHNICAL FIELD

This disclosure relates to the technical field of a faucet device, and more particularly to a multifunctional pullout faucet which has hot and cold water and purified water in one set.

BACKGROUND ART

With the improvement of people's quality of life, the requirement for drinking water has been greatly increased. Most housingholds now have a water purifier installed, and then have a corresponding faucet for supplying the purified water. Generally, there will be another faucet equipped in the kitchen for daily use. In this situation, the countertop in the kitchen will have to provide two installation holes for the two faucets, which takes up a large of space and costs a lot.

SUMMARY

This disclosure provides a multifunctional pullout faucet which is low cost and is convenient for use. The multifunctional pullout faucet also has hot and cold water and purified water in one set, aiming at providing a solution to the problem that there has to be two faucets installed in the kitchen for supplying both mixed water (hot and cold water mixed together) and purified water.

The disclosure is realized as follows.

A multifunctional pullout faucet having mixed water and purified water in one set. The multifunctional pullout faucet comprises a pullout head, a faucet body including a housing connected to the pullout head, and a pullout hose assembly arranged within the housing.

The pullout head is provided with a purified-water outlet path and a mixed-water outlet path therein. The purified-water outlet path is configured for outputting purified water, and the mixed-water outlet path is configured for outputting the mixed-water out of the pullout head.

The faucet body includes a housing, a valve, a mixed-water outlet tube, a purified-water inlet tube, a purified-water outlet tube, a cold-water inlet tube, a hot-water inlet tube, a purified-water switch and a mixed-water switch. The valve is arranged within the housing, and the housing is connected to the pullout head.

The pullout hose assembly includes an outlet connector, a hose and an inlet connector which are connected in sequence. A partition wall is provided within the hose along the length direction of the hose. The partition wall divides the interior of the hose into a purified-water channel and a mixed-water channel. The outlet connector has a first outlet connector end and a second outlet connector end. The first outlet connector end is connected to the hose, and the second outlet connector end, opposite to the first outlet connector end, is connected to the pullout head. By being so, the purified-water channel can be in communication with the purified water outlet path and the mixed-water channel can be in communication with the mixed-water outlet path. The hose travels through the housing and partially extends out of the housing and is connected to a first inlet connector end. A second inlet connector end, opposite to the first inlet connector end, is connected to the purified-water outlet tube and the mixed-water outlet tube, so that the purified-water channel can be in communication with the purified-water outlet tube and the mixed-water channel can be in communication with the mixed-water outlet tube. A purified-water switch is configured to control output of the purified water from the purified-water outlet tube, and a mixed-water switch is configured to control output of the mixed-water from the mixed-water outlet tube.

In some embodiments, a purified-water channel cross-sectional area is smaller than a mixed-water channel cross-sectional area. Furthermore, the purified-water channel cross-sectional area and the mixed-water channel cross-sectional area are circular or semi-circular.

In some embodiments, a hose cross-section is circle-shaped, a flat 8-shaped or ellipse-shaped.

In some embodiments, the pullout hose assembly further includes an outlet sleeve and an inlet sleeve. The hose comprises a first hose end and a second hose end opposite to the first hose end. The outlet connector is shaped to conform with the first hose end, and the inlet connector is shaped to conform with the second hose end, opposite to the first hose end. A first outlet sleeve end is connected to the pullout head, and a second outlet sleeve end, opposite to the first outlet sleeve end, is fitted over the first hose end. The second hose end, opposite to the first hose end, is fit inside the inlet sleeve. Both the outlet sleeve and the inlet sleeve are in sealed connection with the hose by over molding or riveting process.

In some embodiments, the inlet sleeve is further connected to a quick-connect member for connecting with the purified-water outlet tube and the mixed-water outlet tube. A gasket is arranged between the outlet sleeve and the pullout head. Preferably, the gasket is special shaped.

In some embodiments, a bushing is disposed within the housing for anchoring the purified-water inlet tube, the cold-water inlet tube, the hot-water inlet tube, the purified-water outlet tube, the mixed-water outlet tube and the hose, and separating them from each other. Wherein, the mixed-water outlet tube is arranged in adjacent to the purified-water outlet tube.

In some embodiments, a release block is provided between the purified-water outlet tube and the mixed-water outlet tube, so that the purified-water outlet tube and the mixed-water outlet tube can be quickly connected to or released from the quick-connect member.

In some embodiments, the cold-water inlet tube, the hot-water inlet tube, the purified-water outlet tube, the mixed-water outlet tube and the hose are all made of copper and are all connected to the valve by welding.

In some embodiments, the pullout head comprises a purified-water outlet port which is in communication with the purified-water outlet path. Correspondingly, the purified-water outlet port is arranged on the top of a water-outlet surface of the pullout head and is partially extended along a water-outlet direction from the water-outlet surface. The purified-water outlet port is shaped to be circular or other special shapes.

In some embodiments, the valve and the housing are detachable to each other.

In some embodiments, in order to provide convenience to distinguish those water paths from each other, the purified-water inlet tube and the purified-water outlet tube are made of coppers and have identical sizes, and the cold-water inlet tube, the hot-water inlet tube, and the mixed-water outlet tube are made of coppers and have identical sizes.

In some embodiments, the pullout faucet is a front-drawing pullout faucet, and the purified-water switch is arranged on a right side thereof. Alternatively, the pullout faucet is a down-drawing pullout faucet, and the purified-water switch is arranged on the front side thereof. The purified-water switch is in the off state when the center line of purified-switch overlaps with the center line of the faucet body.

The beneficial effects of embodiments provided in the disclosure are as follows:

1. Some embodiments provide a multifunctional pullout faucet having mixed water and purified water in one set. The structure consisted of the pullout head and the pullout hose assembly in the multifunctional pullout faucet effectively integrates the purified-water outlet and the mixed-water outlet into one pullout head, providing an economical and less space-occupation solution to solve the problem in traditional kitchens where a separate faucet for outputting purified water may have to be installed apart from the faucet for outputting mixed water.

2. Some embodiments provide use of the outlet sleeve and the inlet sleeve in the disclosed multifunctional pullout faucet to connect the pullout head and the inlet tube. This effectively ensures the connections therebetween to be detachable and, at the same time, leak tight.

3. Some embodiments have a bushing used. The bushing used in the housing of the multifunctional pullout faucet has a special structure to quickly anchor the purified-water inlet tube, the cold-water inlet tube, the hot-water inlet tube, the purified-water outlet tube, the mixed-water outlet tube and the hose, and at the same time providing each of them a secure position. The use of the bushing provides stabilization for the disclosed multifunctional pullout faucet and makes it more convenient in use.

BRIEF DESCRIPTION OF THE DRAWINGS

The embodiments of the disclosure will become apparent and more readily appreciated from the following description of the embodiments, taken in conjunction with the accompanying drawings. It should be understood that the following drawings merely show certain embodiments of the disclosure and therefore should not be considered as limit to the scope of the disclosure. For those skilled in the art, other related drawings may also be obtained based on these drawings without any creative work. In the accompanying drawings.

DETAILED DESCRIPTION

Figure 1:
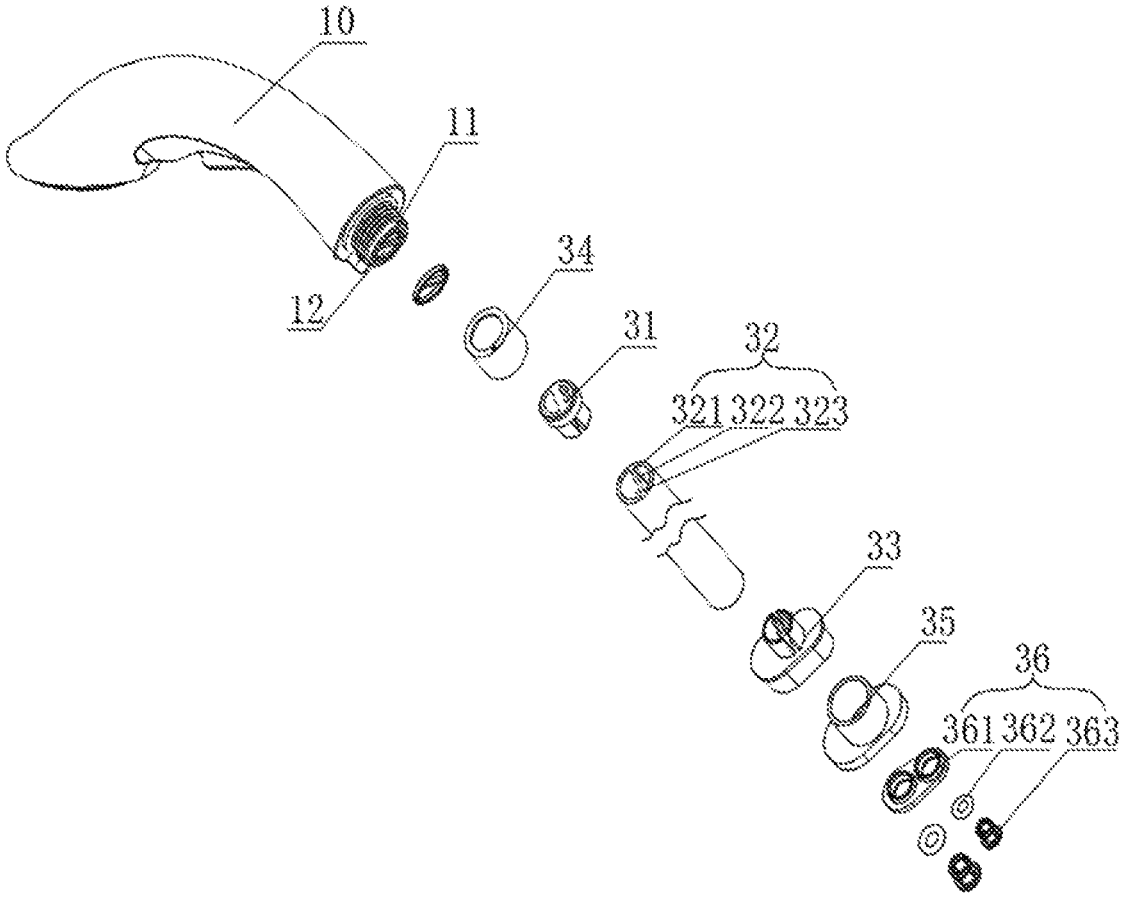
FIG. 1 is an exploded diagram of the multifunctional pullout faucet with a pullout head and a pullout hose assembly according to one embodiment of the disclosure.

Hereinafter, this disclosure will be described in detail in combination with the embodiments and drawings for better understanding the objective, technical solutions and advantages of the present disclosure.

Please refer to FIGS. 1-5, in the embodiment, a multifunctional pullout faucet having mixed water and purified water in one set has been disclosed. The multifunctional pullout faucet comprises a pullout head 10, a faucet body 20 including a housing 21 connected to the pullout head 10, and a pullout hose assembly 30 arranged within the housing 21.

The pullout head 10 is provided with a purified-water outlet path 11 and a mixed-water outlet path 12 inside. The purified-water outlet path 11 is configured for outputting purified water, and the mixed-water outlet path 12 is configured for outputting mixed water.

The faucet body 20 includes a housing 21, a valve 22, a mixed-water outlet tube 23, a purified-water inlet tube 24, a purified-water outlet tube 25, a cold-water inlet tube 26, a hot-water inlet tube 27, a purified-water switch 28 and a mixed-water switch 29. The valve 22 is arranged within the housing 21, and the housing 21 is connected to the pullout head 10.

The pullout hose assembly 30 is arranged within the housing 21, wherein the pullout hose assembly 30 includes an outlet connector 31, a hose 32 and an inlet connector 33 which are connected in sequence. Wherein, a partition wall 321 is provided within the hose 32 in the length direction of the hose 32. The partition wall 321 divides the interior of the hose 32 into a purified-water channel 322 and a mixed-water channel 323. The outlet connector 31 has a first outlet connector end and a second outlet connector end opposite to the first outlet connector end. The first outlet connector end is connected to the hose 32 and the second outlet connector end is connected to the pullout head 10, so that the purified-water channel 322 can be in communication with the purified-water outlet path 11 and the mixed-water channel 323 can be in communication with the mixed-water outlet path 12. The hose 32 travels through the housing 21 and partially extends out of the housing 21 and is connected to a first inlet connector end. A second inlet connector end, opposite to the first inlet connector, is connected to the purified-water outlet tube 25 and the mixed-water outlet tube 23, so that the purified-water channel 322 can be in communication with the purified-water outlet tube 25 and the mixed-water channel 323 can be in communication with the mixed-water outlet tube 23. A purified-water switch 28 is configured to control output of the purified water from the purified-water outlet tube 25, and a mixed-water switch 29 is configured to control output of the mixed water from the mixed-water outlet tube 23.

The structure consisted of the pullout head and the pullout hose assembly in the multifunctional pullout faucet effectively integrates the purified-water outlet and the mixed-water outlet into one pullout head, providing an economical and less space-occupation solution to solve the problem in traditional kitchens where a separate faucet for outputting purified water may have to be installed apart from the faucet for outputting mixed water.

Figure 2:
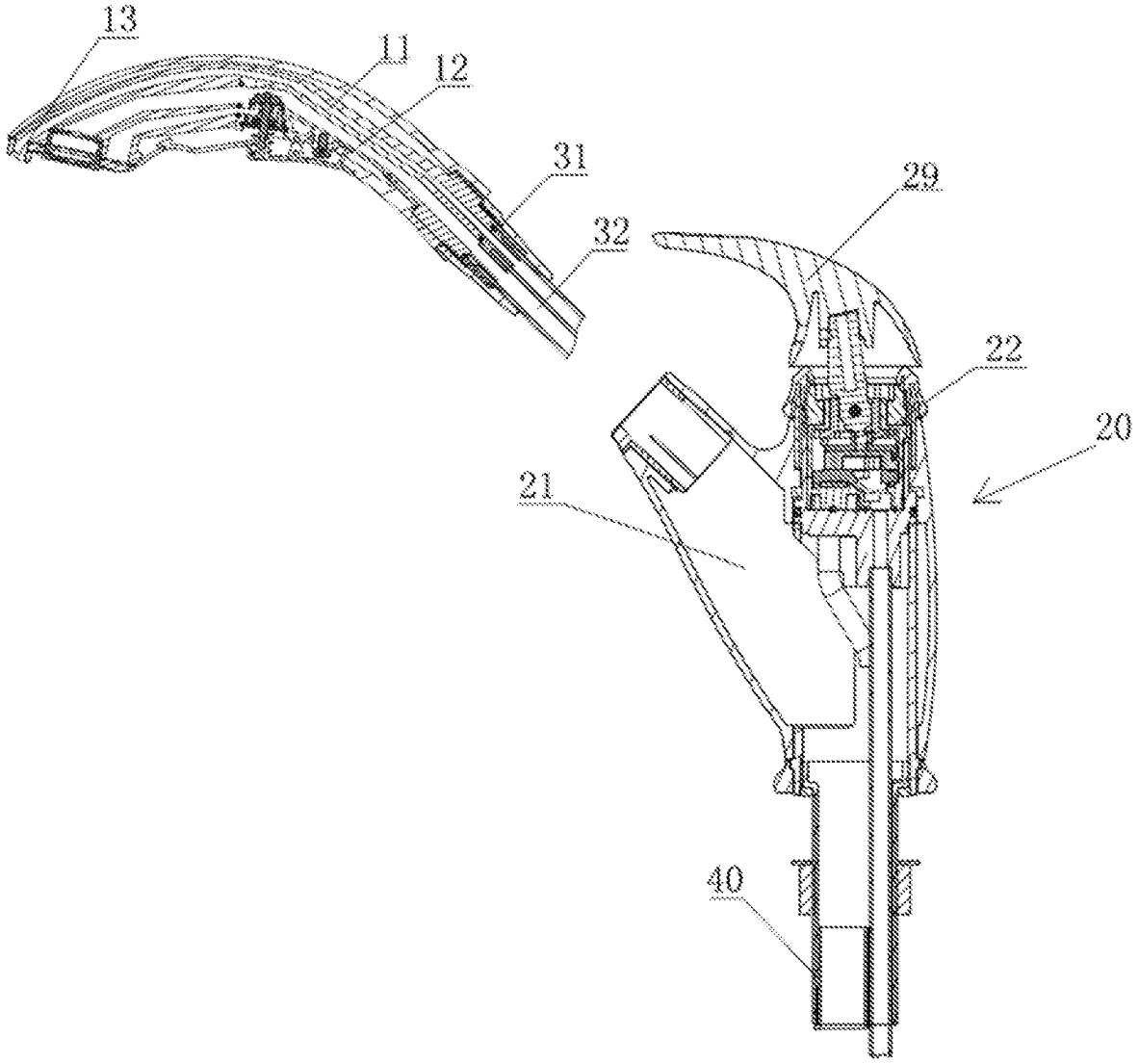
FIG. 2 is cross-sectional view of the multifunctional pullout faucet from its symmetry plane according to one embodiment of the disclosure.

Please refer to FIGS. 1-2, in the embodiment, the cross-sectional area of the purified-water channel 322 is smaller than the cross-sectional area of the mixed-water channel 323, because there is limit space within the hose 32 and the flow requirement for the purified water is lower than the flow requirement for the mixed water. In a further embodiment, the cross-sectional area of the purified-water channel 322 and the mixed-water channel 323 are circular or semi-circular.

Furthermore, a cross-section area of the hose 32 is circle-shaped, flat 8-shaped or ellipse-shaped. It is to be understood that the cross-section area of the hose can be varied for different purposes.

Please refer to FIG. 1, in the embodiment, the pullout hose assembly 30 further includes an outlet sleeve 34 and an inlet sleeve 35. The outlet connector 31 and the inlet connector 33 are respectively adapted to both ends of the hose 32. The outlet connector is shaped to conform with a first hose end, and the inlet connector is shaped to conform with a second hose end opposite to the first hose end. A first outlet sleeve end is connected to the pullout head 10, and a second outlet sleeve end, opposite to the first outlet sleeve end, is fit over the first hose end. The second hose end is fit inside the inlet sleeve 35. Both of the outlet sleeve 34 and the inlet sleeve 35 are in sealed connection with the hose 32 by over molding or riveting process. The use of outlet sleeve and the inlet sleeve to connect the pullout head, and the inlet tube in this embodiment effectively ensures the connections therebetween to be detachable and, at the same time, leak tight.

Furthermore, the inlet sleeve 35 is further connected to a quick-connect member 36 for connecting with the purified-water outlet tube 25 and the mixed-water outlet tube 23. The inlet end of the hose 32 is provided with a quick-connect member 36. As can be seen in FIG. 1, there are two sets of quick-connect members having different sizes. In this embodiment, the first quick-connect member is configured for coupling the purified-water outlet tube 25, and the second quick-connect member which is size-larger than the first quick-connect member is configured for coupling the mixed-water outlet tube 23. Two channels in different sizes within the hose 32 are adapted to two channels in different sizes within the inlet port of the pullout head 10. The size-smaller channel within the hose 32 is coupled to the size-smaller channel of the pullout head 10, and the other channel of the hose 32 is coupled to the other channel of the pullout head 10. The quick-connect member 36 comprises a quick-connect fixing base 361, a quick-connect O-ring 362, and a quick connector 363. Furthermore, a special-shaped gasket is arranged between the outlet sleeve 34 and the pullout head 10. The use of the quick-connect member 36 improves the installation efficiency by accelerating the assembling/disassembling of the purified-water outlet tube 25 and the mixed-water outlet tube 23.

Figure 3:
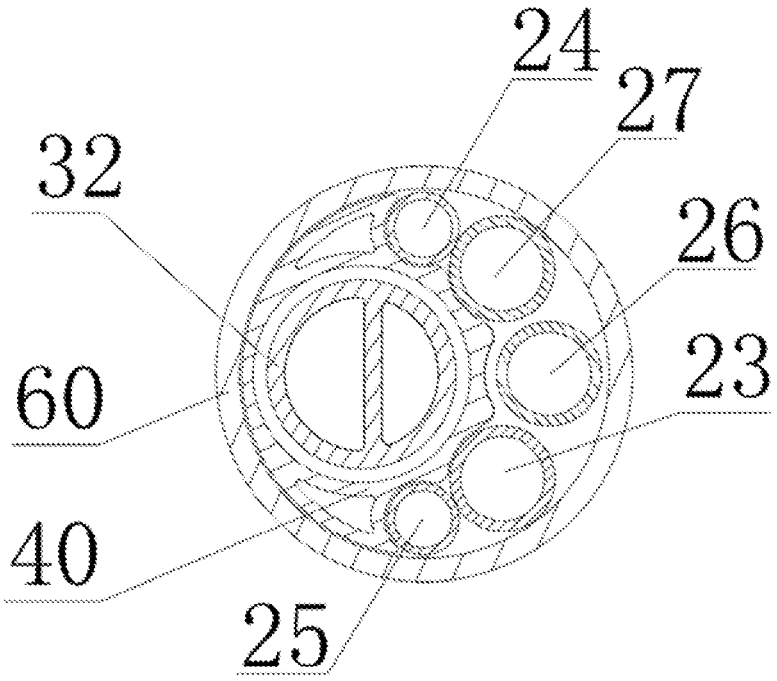
FIG. 3 is a cross-sectional view of the multifunctional pullout faucet in the position of the bushing according to one embodiment of the disclosure.

Please refer to FIG. 3, in the embodiment, a bushing 40 is disposed within the housing 21 for anchoring the purified-water inlet tube 24, the cold-water inlet tube 26, the hot-water inlet tube 27, the purified-water outlet tube 25, the mixed-water outlet tube 23 and the hose 32, and separating them from each other. Wherein, the mixed-water outlet tube 23 is arranged in adjacent to the purified-water outlet tube 25, so that the mixed-water outlet tube 23 and the purified-water outlet tube 25 may establish a connection with the inlet port of the hose 32 quickly.

Figure 4:
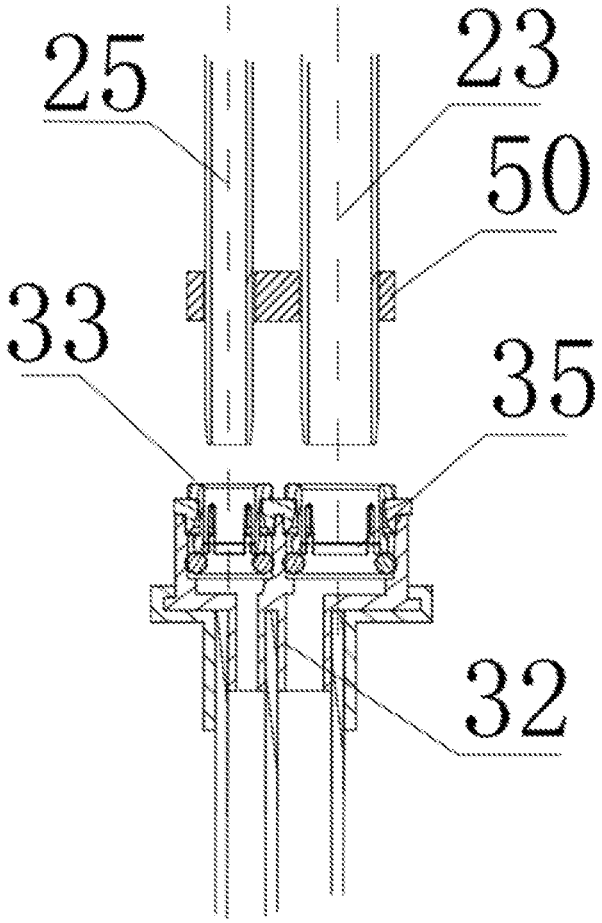
FIG. 4 is an exploded diagram of the multifunctional pullout faucet in the position of the inlet connector according to one embodiment of the disclosure.

Please refer to FIG. 4, in the embodiment, a release block 50 is provided between the purified-water outlet tube 25 and the mixed-water outlet tube 23, so that the purified-water outlet tube 25 and the mixed-water outlet tube 23 can be quickly connected to or released from the quick-connect member 36.

Additionally, the cold-water inlet tube 26, the hot-water inlet tube 27, the purified-water outlet tube 25, the mixed-water outlet tube 23 and the hose 32 are all made of copper and are all connected to the valve 22 by welding.

Pleases still refer to FIG. 1, the purified-water outlet path 11 is disposed at the top within the pullout head 10. The pullout head 10 is provided with a purified-water outlet port 13 which is in communication with the purified-water outlet path 11. Correspondingly, the purified-water outlet port 13 is arranged on a top of a water-outlet surface of the pullout head 10 and is partially extended along a water-outlet direction from the water-outlet surface. The purified-water outlet port 13 is shaped to be circular or other special shapes. It is to be understood that the shape of the purified-water outlet port 13 can be varied for different purposes.

Please refer to FIG. 2, the valve 22 and the housing 21 are designed in lines with separated structural design so that the valve 22 and the housing 21 are detachable to each other. By being so, the manufacturing and machining of the valve 22 and the housing 21 can be easier.

Please refer to FIG. 3, in the embodiment, the cross-sectional areas of the purified-water inlet tube 24 and the purified-water outlet tube 25 are smaller than the cross-sectional areas of the cold-water inlet tube 26, the hot-water inlet tube 27 and the mixed-water outlet tube 23, because there are limit space within the tube casing and the flow requirement for the purified water is lower than the flow requirement for the mixed water. At the same time, in order to provide convenience to distinguish those water paths from each other, the purified-water inlet tube 24 and the purified-water outlet tube 25 adopt one model copper tube, and the cold-water inlet tube, the hot-water inlet tube, and the mixed-water outlet tube adopt another model copper tube.

Figure 5:
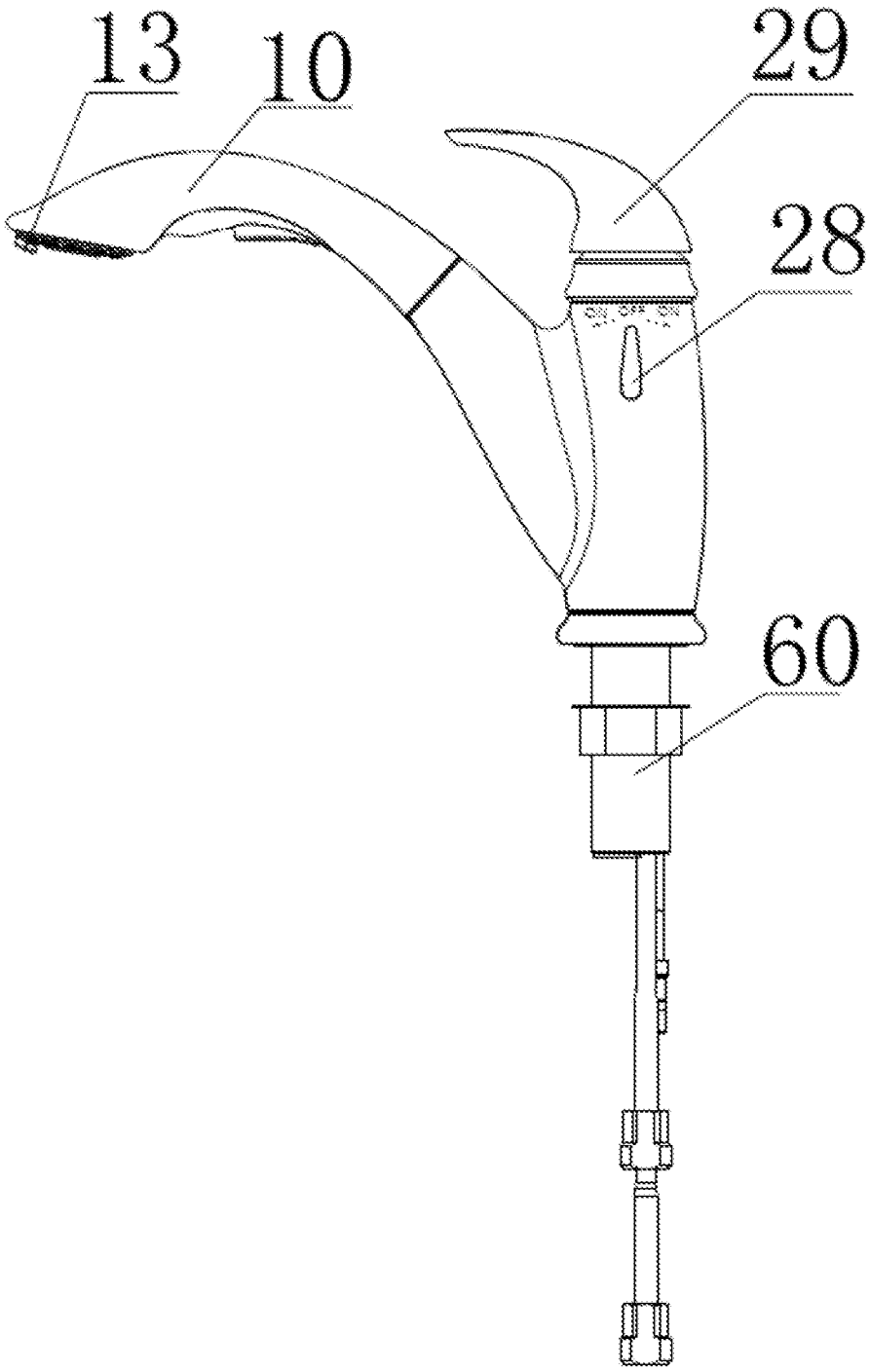
FIG. 5 is a perspective view of the front-drawing pullout faucet according to one embodiment of the disclosure.
Figure 6:
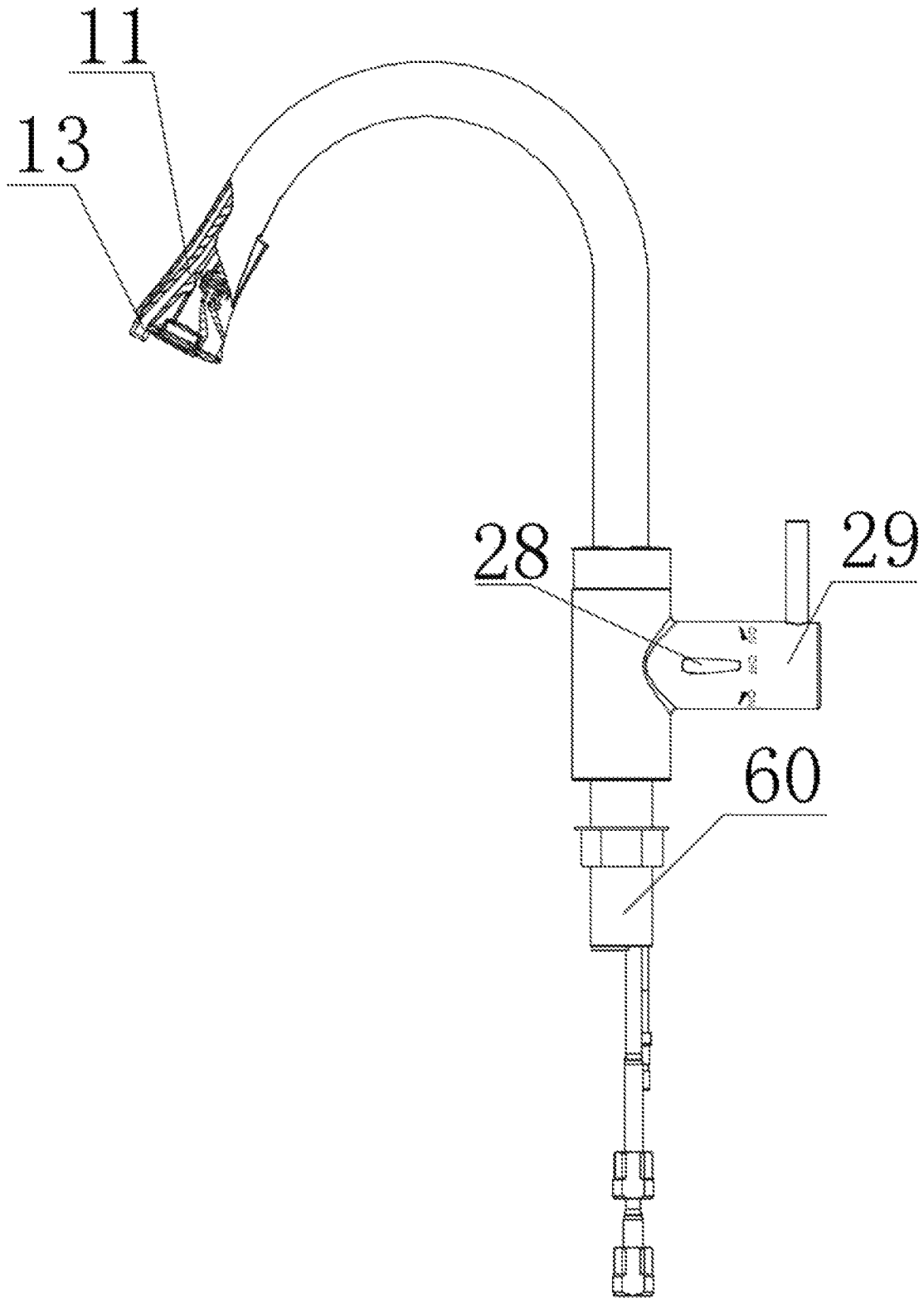
FIG. 6 is a perspective view of the down-drawing pullout faucet according to another embodiment of the disclosure.

Please refer to FIGS. 5 and 6, in the embodiment, the pullout faucet is a front-drawing pullout faucet, and in such case, the purified-water switch 28 is arranged on a right side of the pullout faucet. Alternatively, the pullout faucet is a down-drawing pullout faucet, and in such case, the purified-water switch 28 is arranged on a front side of the pullout faucet. In each embodiment disclosed above, the purified-water switch is in the off state when the center line of purified-water switch 28 overlaps with the center line of the faucet body 20.

Besides, the pullout faucet is secured to the countertop in the kitchen by a fixing casing 60.

The above description is merely some specific embodiments of the present invention. However, the protection scope of the present invention is not limited thereto. Any variation or substitution derived from the present invention without creative efforts falls within the protection scope of the present invention.

NUMERICAL REFERENCES

Pullout head 10,
Purified-water outlet path 11,
Mixed-water outlet path 12,
Purified-water outlet port 13,
Faucet body 20,
Housing 21, Valve 22, Mixed-water outlet tube 23, Purified-water inlet tube 24, Purified-water outlet tube 25, Cold-water inlet tube 26, Hot-water inlet tube 27, Purified-water switch 28,
Mixed-water switch 29,
Pullout hose assembly 30,
Outlet connector 31,
Hose 32, Partition wall 321, Purified-water channel 322, Mixed-water channel 323,
Inlet connector 33,
Outlet sleeve 34,
Inlet sleeve 35,
Quick-connect member 36,
Quick-connect fixing base 361, Quick-connect O-ring 362, Quick connector 363,
Bushing 40,
Release block 50,
Fixing casing 60

What is claimed is:

1. An apparatus comprising: a pullout faucet, wherein the pullout faucet comprises:

a pullout head, wherein the pullout head comprises a purified-water outlet path and a mixed-water outlet path located inside therein; wherein the purified-water outlet path is configured for outputting purified water, and the mixed-water outlet path is configured for outputting mixed-water out of the pullout head;

a faucet body, wherein the faucet body includes a housing, a valve, a mixed-water outlet tube, a purified-water inlet tube, a purified-water outlet tube, a cold-water inlet tube, a hot-water inlet tube, a purified-water switch and a mixed-water switch; wherein the valve is arranged within the housing, and the housing is connected to the pullout head;

a pullout hose assembly arranged within the housing, wherein the pullout hose assembly includes an outlet connector, a hose and an inlet connector, which are connected in sequence;

wherein the pullout hose defines two channels, a partition wall is located within the hose along a length direction of the hose, the partition wall divides the interior of the hose into a purified-water channel and a mixed-water channel, the purified-water channel and the mixed-water channel are the two channels of the pullout hose; a first outlet connector end is connected to the hose and a second outlet connector end, opposite to the first outlet connector end, is connected to the pullout head, so that the purified-water channel is in communication with the purified-water outlet path and the mixed-water channel is in communication with the mixed-water outlet path; the hose travels through the housing, extends out of the housing and is connected to a first inlet connector end; a second inlet connector end, opposite to the first inlet connector end, is connected to the purified-water outlet tube and the mixed-water outlet tube, so that the purified-water channel is in communication with the purified-water outlet tube and the mixed-water channel is in communication with the mixed-water outlet tube; the purified-water switch is configured to control output of the purified water from the purified-water outlet tube; and the mixed-water switch is configured to control output of the mixed water from the mixed-water outlet tube; the pullout hose assembly further comprises an outlet sleeve and an inlet sleeve; wherein the outlet connector is shaped to conform with a first hose end, and the inlet connector is shaped to conform with a second hose end, opposite to the first hose end; wherein a first outlet sleeve end is connected to the pullout head and a second outlet sleeve end, opposite to the first outlet sleeve end, is fit over the first hose end; wherein the second hose end, opposite to the first hose end, is fit inside the inlet sleeve; the inlet sleeve is further connected to a quick-connect member for coupling with the purified-water outlet tube and the mixed-water outlet tube; and a release block is provided between the purified-water outlet tube and the mixed-water outlet tube, so that the purified-water outlet tube and the mixed-water outlet tube is capable of being quickly connected to or released from the quick-connect member.

2. The apparatus according to claim 1, wherein a purified-water channel cross-sectional area is smaller than a mixed-water channel cross-sectional area; wherein the purified-water channel cross-sectional area and the mixed-water channel cross-sectional area are circular or semi-circular.

3. The apparatus according to claim 1, wherein a hose cross-section is circle-shaped, flat 8-shaped or ellipse-shaped.

4. The apparatus according to claim 1, wherein both of the outlet sleeve and the inlet sleeve are in sealed connection with the hose by over molding or riveting process.

5. The apparatus according to claim 1, wherein a gasket is arranged between the outlet sleeve and the pullout head.

6. The apparatus according to claim 1, wherein a bushing is disposed within the housing for anchoring the purified-water inlet tube, the cold-water inlet tube, the hot-water inlet tube, the purified-water outlet tube, the mixed-water outlet tube and the hose, and separating them from each other; wherein the mixed-water outlet tube is arranged in adjacent to the purified-water outlet tube.

7. The apparatus according to claim 6, wherein the cold-water inlet tube, the hot-water inlet tube, the purified-water outlet tube, the mixed-water outlet tube and the hose are all made of copper, and are all connected to the valve by welding.

8. The apparatus according to claim 1, wherein the pullout head comprises a purified-water outlet port which is in communication with the purified-water outlet path; wherein the purified-water outlet port is arranged on a top of a water-outlet surface of the pullout head corresponding to the purified-water outlet path and is partially extended along a water-outlet direction from the water-outlet surface; and the purified-water outlet port is shaped to be circular.

9. The apparatus according to claim 1, wherein the valve and the housing are detachable to each other.

10. The apparatus according to claim 1, wherein the purified-water inlet tube and the purified-water outlet tube are made of copper and have identical sizes; and the cold-water inlet tube, the hot-water inlet tube, and the mixed-water outlet tube are made of copper and have identical sizes.

11. The apparatus according to claim 1, wherein the pullout faucet is a front-drawing pullout faucet; the purified-water switch is arranged on a side of the pullout faucet.

12. The apparatus according to claim 1, wherein the pullout faucet is a down-drawing pullout faucet; the purified-water switch is arranged on the front side of the pullout faucet.

13. The apparatus according to claim 1, wherein the purified-water switch is on an off state when a purified-water switch center line overlaps with a faucet body center line.

* * * * *